US007029168B2

(12) United States Patent
Reime

(10) Patent No.: US 7,029,168 B2
(45) Date of Patent: Apr. 18, 2006

(54) CLOCK

(76) Inventor: Gerd Reime, Friedenstrasse 88, D-75328 Schömberg (DE)

( * ) Notice: Subject to any disclaimer, the term of this patent is extended or adjusted under 35 U.S.C. 154(b) by 354 days.

(21) Appl. No.: 10/399,847

(22) PCT Filed: Oct. 23, 2001

(86) PCT No.: PCT/EP01/12230

§ 371 (c)(1),
(2), (4) Date: Apr. 21, 2003

(87) PCT Pub. No.: WO02/35295

PCT Pub. Date: May 2, 2002

(65) Prior Publication Data

US 2004/0027922 A1 Feb. 12, 2004

(30) Foreign Application Priority Data

Oct. 28, 2000 (DE) ..... 200 18 537 U

(51) Int. Cl.
*G04F 1/04* (2006.01)

(52) U.S. Cl. ..... 368/93

(58) Field of Classification Search ..... 368/76, 368/93, 139, 179, 327
See application file for complete search history.

(56) References Cited

U.S. PATENT DOCUMENTS

| | | | | |
|---|---|---|---|---|
| 2,749,700 | A * | 6/1956 | Seligman | 368/65 |
| 4,028,877 | A * | 6/1977 | Vatterott | 368/65 |
| 4,262,348 | A * | 4/1981 | Hess | 368/65 |
| 4,372,688 | A * | 2/1983 | Chatten | 368/65 |
| 4,455,094 | A * | 6/1984 | Russell | 368/65 |

FOREIGN PATENT DOCUMENTS

DE 31 35 859 A 3/1983

* cited by examiner

*Primary Examiner*—P. Austin Bradley
*Assistant Examiner*—Jeanne-Marguerite Goodwin
(74) *Attorney, Agent, or Firm*—Stites & Harbison, PLLC

(57) ABSTRACT

A mechanical clock has a driving element and a braking element. The braking action of the braking element is based on a hydrostatic gradient of at least one flowable medium. The driving element exerts a first torque on a first shaft extending along a first axis, and the braking element exerts a second torque on the first shaft, with the second torque being opposed to the first torque. The braking element has at least one drum which is rotatable around a second axis and in which the flowable medium is located.

22 Claims, 3 Drawing Sheets

CLOCK

REFERENCE TO RELATED APPLICATIONS

The present application claims priority of the German Utility Model Application 200 18 537.3, filed on Oct. 28, 2000, the disclosure content of which is herewith also made the subject of the present application.

DESCRIPTION

1. Field of the Invention

The invention relates to a clock, in particular a wall or hall clock according to the preamble of Claim 1.

2. Prior Art

Traditionally, wall or hall clocks have not only the purpose of informing the observer of the current time, but frequently also serve as decorative pieces or ornaments. The charm of many such clocks is based on the feature that they allow observers a view of their internal workings, which generally comprise complex mechanics with numerous gears, springs etc.

SUMMARY OF THE INVENTION

The object of the present invention is to provide a clock, which operates according to a physical principle that is a typical for a clock. This principle should preferably be clearly visible from the outside.

This object is achieved with a clock with the features of Claim 1.

As is ultimately the case with every mechanical clock, this clock has a driving element and a braking element. The braking element works according to the principle of a hydrostatic gradient. The braking action, i.e. the dissipation of the energy provided by the driving element, is effected by the flow resistance of the medium with the hydrostatic gradient.

Further advantageous configurations of the invention may be seen from the sub-claims.

DETAILED DESCRIPTION OF PREFERRED EMBODIMENTS

The invention will now be explained in more detail with reference to the attached drawings by way of example. However, the embodiments only constitute examples which are not intended to limit the inventive concept to a specific arrangement.

Figure 2:
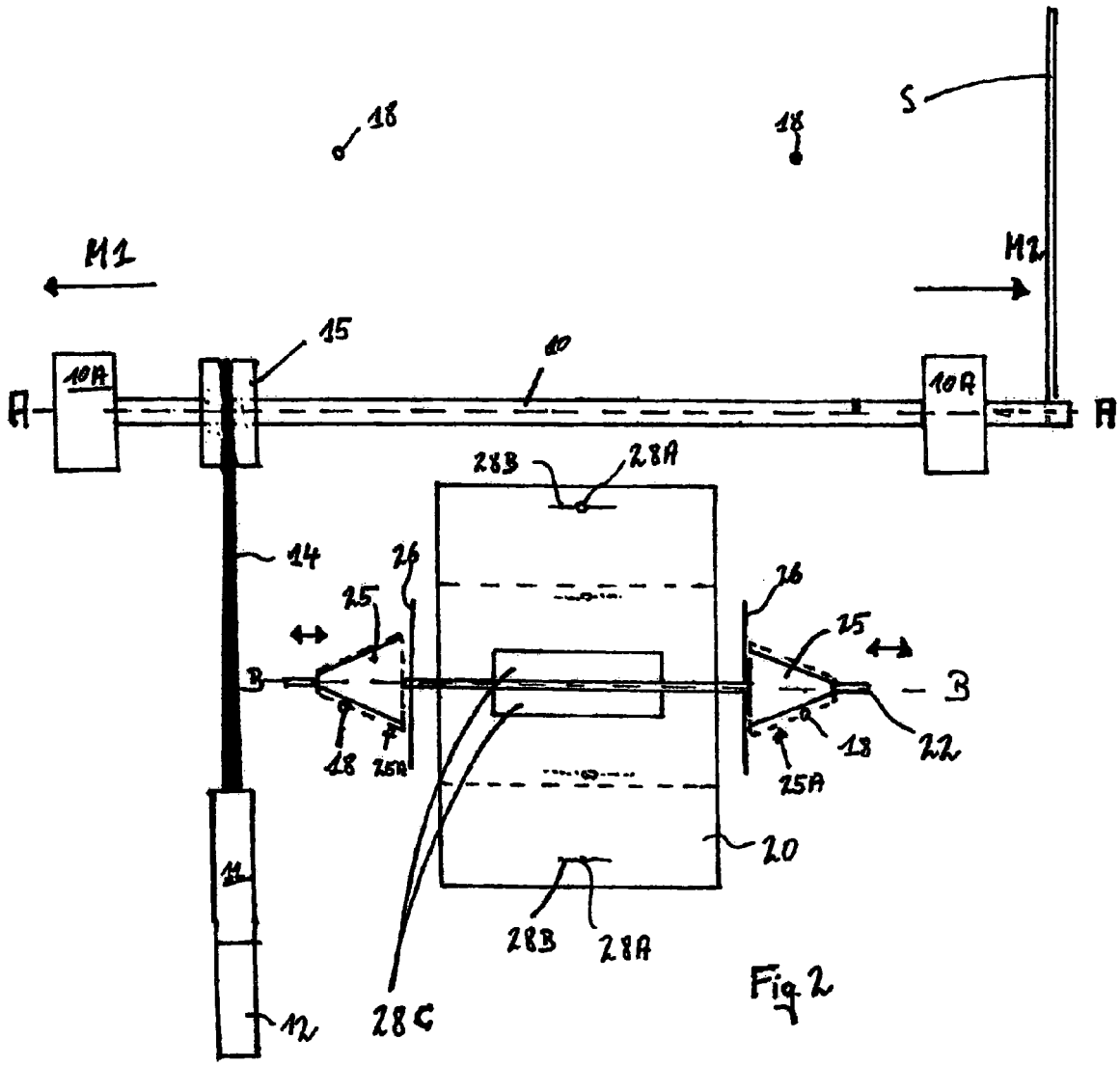
FIG. 2 shows a section taken along line H—H in FIG. 1.

The drive wheel 15 is rigidly disposed on the first shaft 10, which extends coaxially to the axis A—A. The shaft 10 is rotatably held by the two bearings 10A (FIG. 2). The bearings 10A are themselves disposed in a case, which also supports the clock face, for example. The case and clock face are not shown in the figures for reasons of clarity. A cable 14 lies over the drive wheel 15 and has the two different weights 11, 12 disposed at its ends. As a result of the difference in the two weights, a vertical force F1 is exerted onto the drive wheel 15 and from this force a first torque M1 results (see also FIG. 2). Two circular rails 18, which are concentric relative to the first shaft 10, are disposed on the first shaft 10 by means of connecting struts 17. Only the cut faces of the rails 18 with the plane of projection are shown in FIG. 2. The first shaft 10 also supports the hour hand S. As already mentioned above, the associated clock face is not shown for reasons of clarity.

The cylindrical drum 20 has a second shaft 22 that is concentric relative to the axis of symmetry B—B of this drum. At the two ends of the second shaft 22 a running wheel 25 is respectively disposed having a running surface 25A with a surface made of a non-slip material, e.g. rubber. Each of the running surfaces 25 lies on one of the rails 18, so that the drum 20 is partially located between the rails 18. Because of the friction between the rails 18 and the running surfaces 25A, the first shaft 10 and the second shaft 22 are coupled with respect to their rotation. Because of its weight F2, the drum 20 exerts a second torque on the first shaft 10. At equilibrium, the first and second torques are equal, but are directed in opposite directions.

If the drum 20 contained no moveable medium, then a static equilibrium would occur. However, this is not possible here. The drum 20 is divided into six compartments 27. These compartments 27 each have a segment-shaped area and are separated from one another by means of compartment walls 28. A hole 28A is located in each of the compartment walls 28, see FIG. 2, so that respectively adjacent compartments 27 are interconnected. In addition, each compartment wall 28 has an opening 28C close to the axis to equalize air pressure. This is also shown in FIG. 2.

Figure 1:
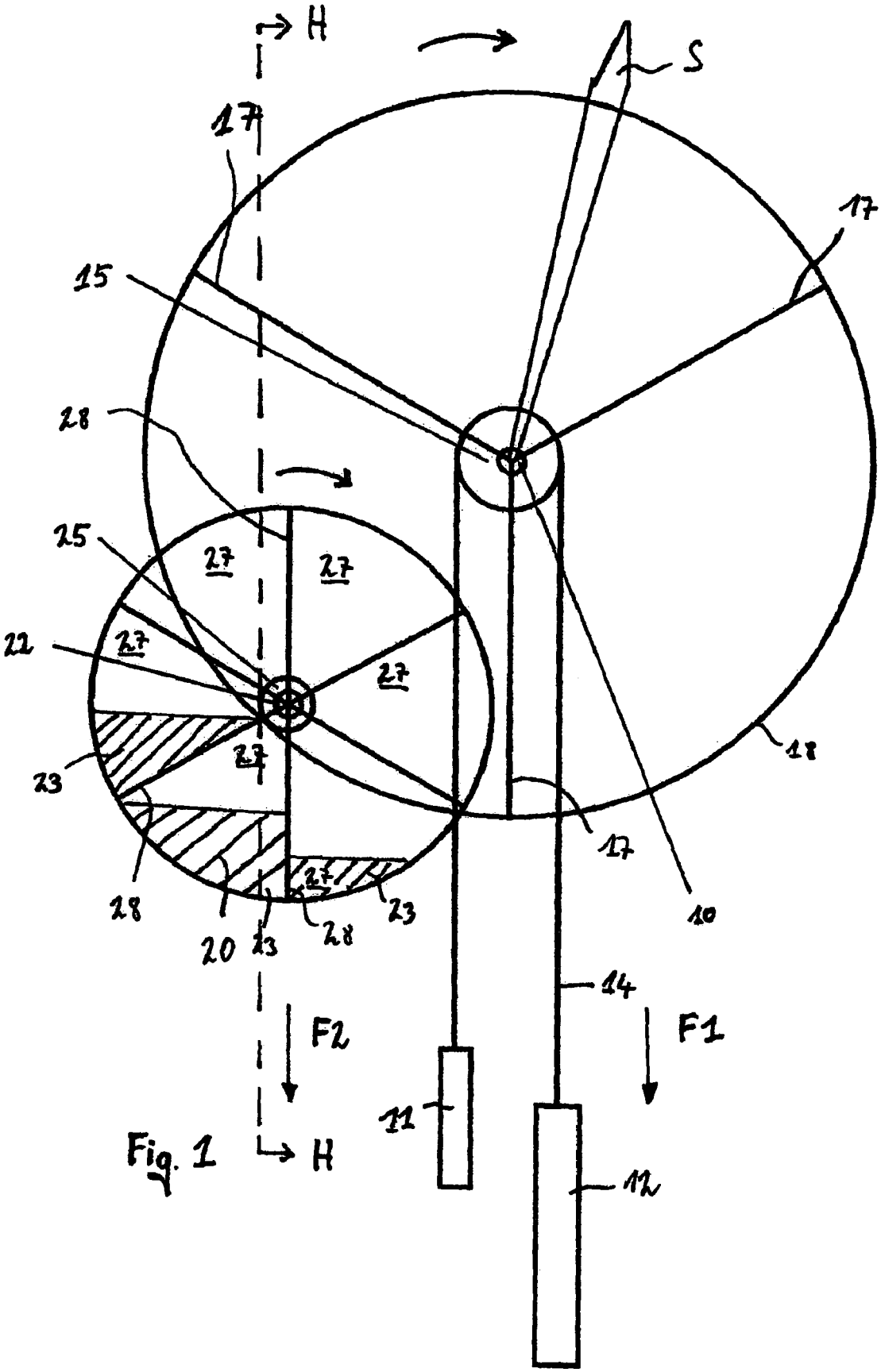
FIG. 1 is a top view onto the entire clock, but without the case and clock face.

The drum 20 is partially filled with a liquid, e.g. water. Since the second shaft 22 is located at a point of the rails 18 where their tangent does not run horizontally, a torque acts on the second shaft 22 because of the weight of the drum or of the water located in the drum. This causes the compartments located on the left side to be raised as a result of a rotation of the drum until an equilibrium of forces or a torque balance results in turn from the different water levels inside the compartments. Because of the differences in levels, water flows out of the compartments in which the water level is higher, into those in which the water level is lower. The different water levels are indicated in FIG. 1 by means of shaded areas with the reference numeral 23.

The driving element exerts a first torque on a shaft, which can support the hour hand, for example. This driving element can act gravitationally, for example. A braking element opposes the torque generated by the driving element. The equilibrium between the driving and braking elements is responsible for the speed and therefore the precision of the clock. The braking element is formed by the drum 20, which is partially filled with liquid and is disposed to rotate around a second shaft 22. The drum is coupled to the first shaft with respect to its rotational movement. The braking action results from the flow resistance of the liquid inside the drum. Coupling of the rotational movements only occurs indirectly. The braking torque opposed to the driving torque is generated gravitationally.

The speed of these flow movements is determined by the size of the holes 28*a* and the viscosity of the water. As a result of these flow movements, the drum 20 and therefore the rails 18 or the first shaft 10 rotate. The flow resistance of the water acts as a brake in this case.

The fine adjustment of the operating speed of the clock is achieved by means of adjusting wheels 26 (see FIG. 2). The running surfaces 25A are truncated cone-shaped. The running wheels 25 and therefore also the running surfaces 25A can be shifted in their axial position by means of the adjusting wheels 26 and two screw threads (not shown). As a result, the point where the running surfaces 25A lie on the rails 18, and therefore the effective circumference of the running surfaces 25A, and thus also the effective radius can be varied. As a result of such a variation, the transmission ratio between the first shaft 10 and the second shaft 22 is varied. Therefore, a reduction in the effective circumference of the running surface 25A causes the clock to slow down and vice versa.

Figure 4:
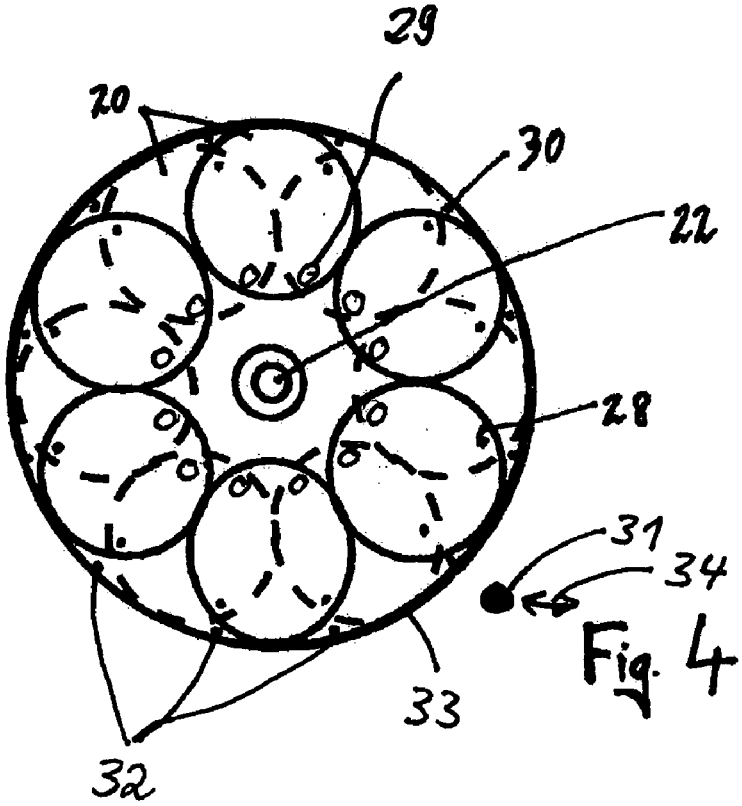
FIG. 4 is a top view onto a further braking element.

The control element can also be formed by a magnet 31, preferably a bar magnet, as shown in FIG. 4. The compartments are held together by screws 32 in the crown 33. If the magnet is now positioned so as to pivot in the vicinity of the crown, preferably arranged above the crown, then at the correct point it ensures that the water level is lower than without a magnet, since it attracts the screw. If the clock is set to be slightly slow from the outset, it can be finely adjusted by means of the magnet 31 as a result of the magnet 31 being pivoted more or less towards the screws 32 in the direction of the arrow 34. The magnet is preferably arranged symmetrically to the central plane of the clock in side view. A corresponding configuration may, of course, also be achieved in the other embodiments.

If water is used as flowable medium inside the drum 20, the high surface tension of the water poses something of a problem, even if reduced by additives, e.g. dishwashing detergent. Because the holes 28A must be selected to be relatively small in order to obtain a correspondingly high flow resistance, it can result that the water completely stops flowing because of the high surface tension and this causes the clock to stop. This problem can be overcome by arranging grooves 28B extending from the hole 28A in the compartment wall. Since the water also flows into these grooves starting from the hole 28A, the surface can thus be increased to such an extent that the surface tension is no longer significant.

It is also possible to completely dispense with the compartment walls and use a highly viscous medium instead of water. In this case, the medium, e.g. an oil, constantly has a non-horizontal surface. The braking action here is also mainly based on the internal friction of the oil. However, a problem here is that the viscosity of most highly viscous liquids is highly temperature-dependent, and therefore even slight fluctuations in temperature can lead to considerable differences in precision.

It should also be mentioned that not only liquids are possible as flowable media, but fine-grain solids, e.g. sand or similar, could also serve in principle as flowable medium.

Figure 3:
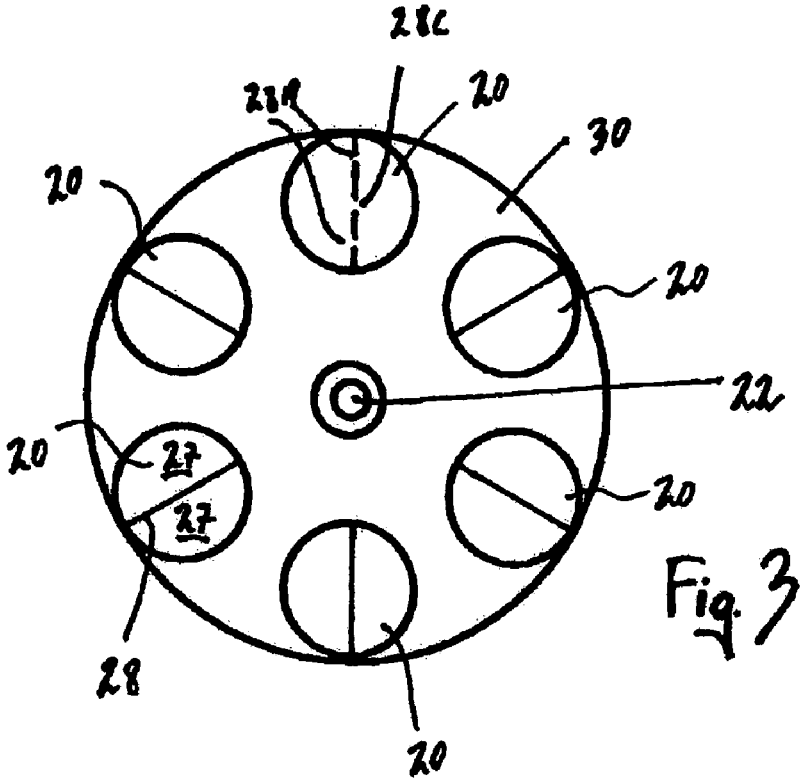
FIG. 3 is a top view in partial section onto a braking element.

FIG. 3 shows a further embodiment of a braking element. Here the second shaft 22, which interacts with the rest of the clock in the same manner as in the embodiment illustrated above, does not directly support a drum, but a circular disc 30 that is concentric relative to the axis B—B. This disc 30 supports six symmetrically arranged drums 20. The number of drums 20 can be selected as desired, but must amount to at least two. Each drum 20 is divided into two compartments 27 by means of a compartment wall 28. Each of the compartment walls has two holes 28A located at the edge and a central opening 28C. This is only shown by way of the drum located at the top position. As in the first embodiment, the holes 28A are for the flow of water and with their size determine the flow resistance. Grooves that extend away from the holes are also provided in the compartment walls in this embodiment. These grooves are not shown in FIG. 3. The openings 28C serve to equalize the air pressure. The opening 28C may also be dispensed with, depending on the diameter of the holes 28A.

FIG. 4 shows a third embodiment of a braking element. A round disc 30 is likewise arranged on the second shaft 22 here. This disc 30 supports six drums 20 on each side, each drum overlapping two drums of the other side in top view. In this case also the number of drums on each side need not necessarily amount to six. The drums of the rear side of the disc are shown in broken lines in FIG. 4. The overlapping drums 20 are respectively interconnected by means of a hole 28 extending through the disc 30, so that the water located in the drums can flow between adjacent drums. The drums 20 here have the function of the compartments 27 of the first embodiment. To facilitate escape of the displaced air, internal air holes 29 can be provided which are generally larger than the external holes 28. It is also advantageous to provide grooves here which extend away from the holes 28.

The running surfaces and drums may also be actively interconnected via crown wheels. In order to facilitate setting of the clock in such a case, the weight or weights 11, 12 should be interchangeable or their weights variable.

It is fundamentally also possible to arrange a braking element, i.e. a drum shown in the first embodiment, for example, directly on the first shaft 10 and rigidly connect it to this. In this case, the first axis A—A and the second axis B—B would then coincide.

Since the principle by which the clock works should be visible from the outside, it is advantageous to produce the drum or drums from a transparent material such as plexiglass, for example.

It should also be understood that this description can be subject to a wide variety of modifications, changes and adaptations, which revolve around equivalents to the attached claims.

List of Reference Numerals

| | |
|---|---|
| A-A | first axis |
| B-B | second axis |
| 10 | first shaft |
| 10A | bearing |
| 11 | first weight |
| 12 | second weight |
| 14 | cable |
| 15 | drive wheel |
| 18 | rails |
| 20 | drum |
| 22 | second shaft |
| 23 | liquid |
| 25 | running wheels |
| 25A | running surfaces |
| 26 | adjusting wheel |
| 27 | compartment |
| 28 | compartment wall |
| 28A | hole |
| 28B | groove |
| 28C | opening |
| 29 | air hole |
| 30 | disc |
| 31 | magnet |
| 32 | screws |
| 33 | crown |
| S | hour hand |

The invention claimed is:

1. A clock having at least one driving element and at least one braking element, wherein the braking action of the braking element is based on a hydrostatic gradient of at least one flowable medium, wherein said driving element exerts a first torque (M1) on a first shaft (10) extending along a first axis (A—A) and said braking element exerts a second torque (M2) on to first shaft (10), said second torque being opposed to the first torque (M1), wherein said braking element has at least one drum (20) which is rotatable round a second axis (B—B) and in which said flowable medium is located, and wherein said drum (20) is coupled to the first shaft (10) for rotation.

2. The clock as recited in claim 1, wherein said flowable medium is a liquid.

3. The clock as recited in claim 1, wherein the first shaft is rigidly connected to two circular rails (18), which are concentric about said first axis (A—A).

4. The clock as recited in claim 3, wherein said drum (20) is mounted to a second shaft (22) extending along said second axis (B—B), said second shaft being connected to two cylindrically symmetrical running surfaces (25A), each of said running surfaces (25A) lying on a respective rail (18).

5. The clock as recited in claim 4, wherein to effective circumference of the running surfaces (25A) can be adjusted such that the transmission ratio between the first shaft (10) and to second shaft (22) is varied.

6. The clock as recited in claim 5, wherein said running surfaces (25A) are in the shape of a truncated cone and are axially displaceable, thus allowing for the adjustment of the effective circumference of to running surfaces (25A).

7. The clock as recited in claim 1, wherein only one cylindrical drum (20) is provided, its axis of symmetry being the second axis (B—B).

8. The clock as recited in claim 7, wherein said cylindrical drum (20) is comprised of several compartments (27) separated by compartment walls (28).

9. The clock as recited in claim 8, wherein a projection of the compartments (27) in an axial direction constitutes sectors of a circle, and wherein adjacent compartments (27) are interconnected by respective holes (28A).

10. The clock as recited in claim 9, wherein said compartment walls (28) define at least one groove (28B) extending away from each of said holes (28A).

11. The clock as recited in claim 8, wherein said compartment walls (28) define openings (28C) close to the second axis (B—B).

12. The clock as recited in claim 1, wherein said braking element comprises a plurality of drums (20) which are each divided into at least two compartments (27) by means of at least one compartment wall (28) with at least one hole (28A).

13. The clock as recited in claim 12, wherein each said compartment wall (28) defines at least one groove (28B) extending away from said hole (28A).

14. The clock as recited in claim 12, wherein adjacent drums are interconnected.

15. The clock as recited in claim 1, wherein said driving element includes at least one weight (11, 12).

16. The clock as recited in claim 15, wherein the weight is variable for setting the clock.

17. The clock as recited in claim 15, wherein said flowable medium is water.

18. The clock as recited in claim 17, wherein the water contains a surfactant.

19. The clock as recited in claim 1, wherein said braking element comprises a plurality of drums (20), wherein at least some of the drums are made at least partially of a transparent material.

20. The clock as recited in claim 19, wherein said transparent material is plexiglass.

21. The clock as recited in claim 1, and further comprising a magnet which preferably serves as a control element for fine adjustment of the clock through pivoting of the magnet toward or away from certain metal parts of the clock.

22. The clock as recited in claim 21, wherein said certain metal parts are screws (32).

* * * * *

UNITED STATES PATENT AND TRADEMARK OFFICE

CERTIFICATE OF CORRECTION

PATENT NO. : 7,029,168 B2
APPLICATION NO. : 10/399847
DATED : April 18, 2006
INVENTOR(S) : Gerd Reime It is certified that error appears in the above-identified patent and that said Letters Patent is hereby corrected as shown below:

IN THE CLAIMS:

Claim 5, column 5 lines 20-23 should read: The clock as recited in claim 4, wherein the effective circumference of the running surfaces (25A) can be adjusted such that the transmission ratio between the first shaft (10) and the second shaft (22) is varied.

Claim 6, column 5 lines 24-27 should read: The clock as recited in Claim 5, wherein said running surfaces (25A) are in the shape of a truncated cone and are axially displaceable, thus allowing for the adjustment of the effective circumference of the running surfaces (25A).

Signed and Sealed this

Twenty-second Day of August, 2006

JON W. DUDAS
*Director of the United States Patent and Trademark Office*